United States Patent [19]

Baptista et al.

[11] Patent Number: 4,542,597

[45] Date of Patent: Sep. 24, 1985

[54] SNOW SHIELD FOOT AND LEG INSULATOR

[76] Inventors: Raymond J. Baptista, 15-8 Alger St., New London, Conn. 06320; George Spector, 233 Broadway, Rm. 3615, New York, N.Y. 10007

[21] Appl. No.: 586,294

[22] Filed: Mar. 5, 1984

[51] Int. Cl.[4] ..... A41D 17/00

[52] U.S. Cl. ..... 36/2 R; 36/1.5

[58] Field of Search ..... 36/2 R, 1.5, 2.5, 2 A, 36/2 B; 2/61

[56] References Cited

U.S. PATENT DOCUMENTS

| | | | |
|---|---|---|---|
| 54,585 | 5/1866 | O'Neil | 36/2 R |
| 507,466 | 10/1893 | Oostrum | 36/1.5 |
| 608,253 | 8/1898 | Cook | 36/2 R |
| 979,702 | 12/1910 | Rosenwasser | 36/2 R |
| 1,061,740 | 5/1913 | Gehant | 36/1.5 |
| 1,708,144 | 4/1929 | Martin | 36/2 R |
| 2,248,454 | 7/1941 | Freimark | 36/2 R |
| 3,633,290 | 1/1972 | Rubeling | 36/2 R |

*Primary Examiner*—Werner H. Schroeder
*Assistant Examiner*—Mary A. Ellis

[57] ABSTRACT

A snow shield foot and leg insulator is provided and consists of an inner cloth tube for engagement with a foot and a leg, an outer cloth tube that has its top edge attached to top edge of the inner cloth tube forming a seam, a top sleeve for securing the seam to the leg and a bottom sleeve for securing bottom edge of the outer cloth tube over top portion of a boot placed onto the foot to prevent snow from seeping into the top portion of the boot.

5 Claims, 6 Drawing Figures

SNOW SHIELD FOOT AND LEG INSULATOR

BACKGROUND OF THE INVENTION

The instant invention relates generally to stockings and more specifically it relates to a snow shield foot and leg insulator.

The biggest problem during the winter time during cold snowy days is snow going up the leg under a pants leg and into the top of a boot. The snow can melt wetting the leg and foot and thus ultimately causing frostbite to the lower limb. This situation is not desirable so accordingly it is in need of an improvement.

Numerous stockings have been provided in prior art that are adapted to be worn on a foot and a leg. For example U.S. Pat. Nos. 319,131; 1,299,574 and 3,605,122 all are illustrative of such prior art. While these units may be suitable for the particular purpose to which they address, they would not be suitable for the purposes of the present invention as heretofore described.

SUMMARY OF THE INVENTION

A principle object of the present invention is to provide a snow shield foot and leg insulator that will prevent snow from seeping into the top portion of a boot.

Another object is to provide a snow shield foot and leg insulator that has a lace to feed through the eyelets in the top portion of a boot for securement thereto.

An additional object is to provide a snow shield foot and leg insulator that has an inner mid seal to engage top edge of the boot.

A further object is to provide a snow shield foot and leg insulator that is simple and easy to use.

A still further object is to provide a snow shield foot and leg insulator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
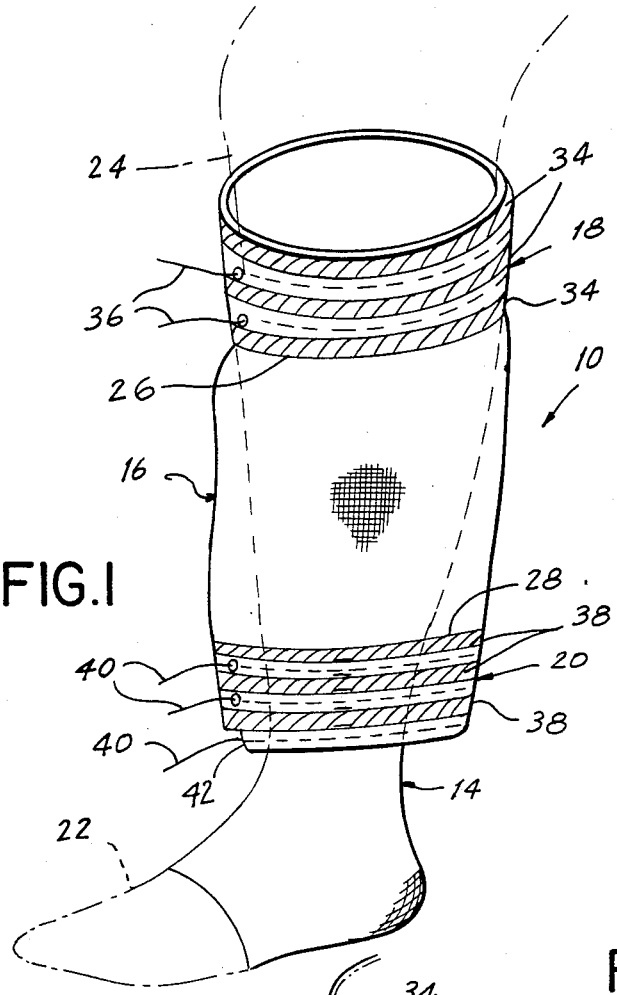
FIG. 1 is a side perspective view of the invention.
Figure 2:
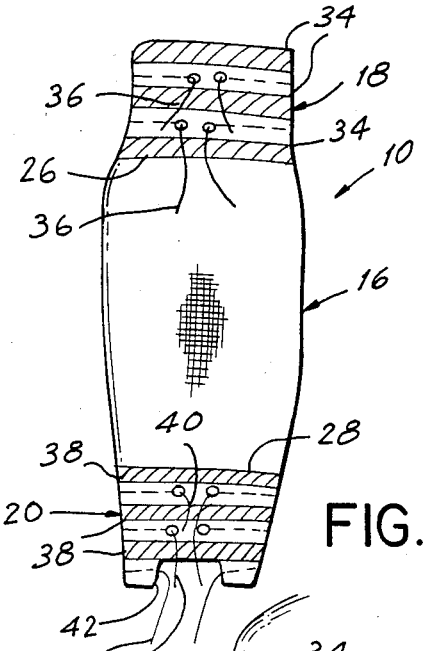
FIG. 2 is a front view of the invention thereof.
Figure 3:
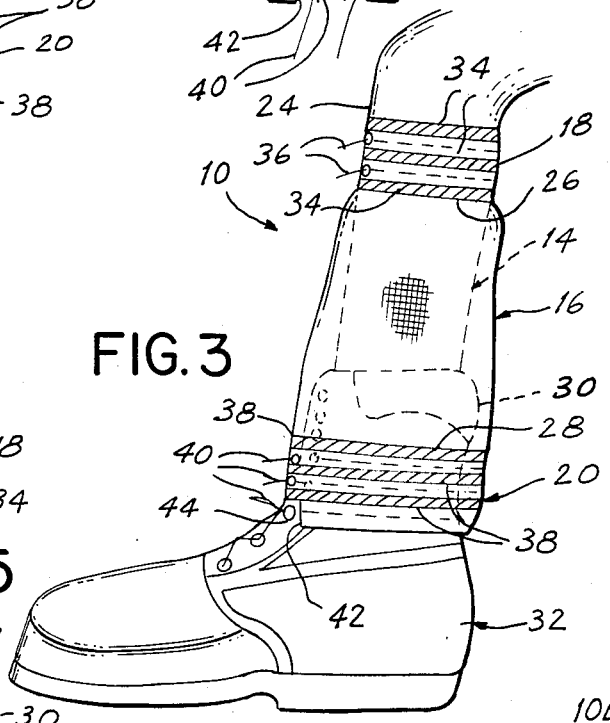
FIG. 3 is a side view of the invention mounted to a boot.

Turning now descriptively to the drawings, in which similar reference characters denote similar elements throughout the several views, FIGS. 1 through 3 illustrates a snow shield foot and leg insulator 10 that consists of an inner cloth tube 14, an outer cloth tube 16, a top sleeve 18 and a bottom sleeve 20.

The inner cloth tube 14 is for engagement with a foot 22 and a leg 24. The outer cloth tube 16 has its top edge attached by sewing to top edge of the inner cloth tube 14 forming a seam 26. The top sleeve 18 is attached to the seam 26 for securing the seam to the leg 24. The bottom sleeve 20 is attached to a bottom edge 28 of the outer cloth tube 16 for securing the bottom edge 28 around a top portion 30 of a boot 32 placed onto the foot 22 to prevent snow from seeping into the top portion 30 of the boot 32.

The top sleeve 18 consists of at least one elastic band 34 and at least one lace 36. The elastic band 34 is attached thereto by sewing while the lace 36 is integrated within the top sleeve 18. The drawings show the top sleeve 18 having three elastic bands 34 and two laces 36 for best results but any other combination can be used.

The bottom sleeve 20 consists of at least one elastic band 38 and at least one lace 40. The elastic band 38 is attached thereto by sewing while the lace 40 is integrated within the bottom sleeve 20. The bottom sleeve 20 has a front cut out portion 42 exposing eyelets 44 in the top portion 30 of the boot 32 so that the lace 40 can engage the eyelets 44. The drawings show the bottom sleeve 20 having three elastic bands 38 and three laces 40 with bottom lace the one to engage the eyelets 44 but any other combination can be used.

The inner cloth tube 14 is made of a 100% nylon shell having a core of 100% polyester filler while the outer cloth tube 16 is made of 100% nylon.

Figure 4:
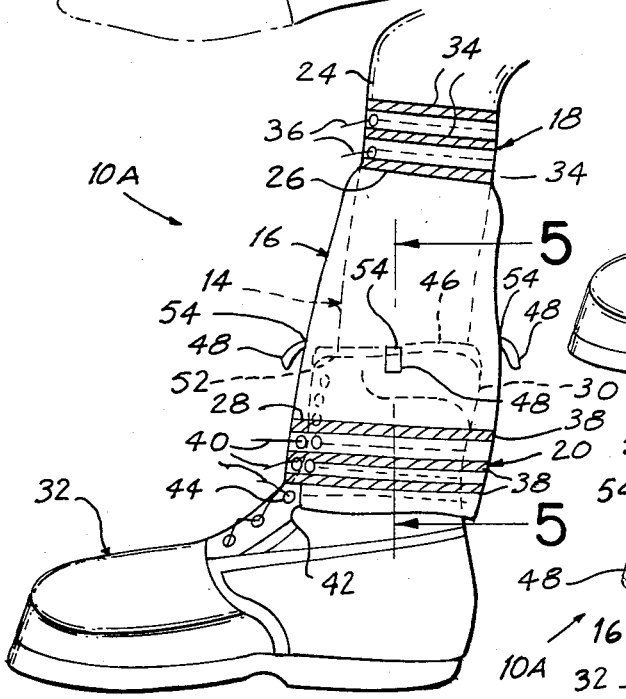
FIG. 4 is a side view of a modification showing an inner mid seal and pull tabs.
Figure 5:
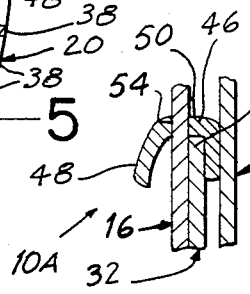
FIG. 5 is a cross sectional view taken along line 5—5 in FIG. 4.

FIGS. 4 and 5 show a first modified snow shield foot and leg insulator 10A. The outer cloth tube 16 contains an inner mid seal 46 and a plurality of pull tabs 48. The inner mid seal 46 is attached to the tube 16 by sewing along inner circumference 50 of the outer cloth tube 16 to engage top edge 52 of the boot 32 and snugly fit between boot 52 and tube 14. The pull tabs 48 are attached by sewing along outer circumference 54 of the outer cloth tube 16 in the vicinity of the inner mid seal 46 for use in positioning the inner mid seal 46 to engage the top edge 52 of the boot 32 and sealingly fit between said boot and tube 14.

Figure 6:
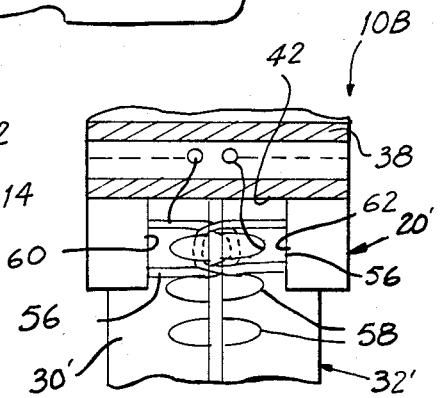
FIG. 6 is a partial front view of another modification showing a cuff with loops to engage boot hooks.

FIG. 6 shows a second modified snow shield foot and leg insulator 10B. Sleeve 20' consists of at least one elastic band 38 and a pair of elastic loops 56. The elastic band 38 is attached thereto by sewing. The bottom sleeve 20' has a front cut out portion 42 exposing hooks 58 in the top portion 30' of the boot 32'. Each loop 56 is attached by sewing to a side 60 and 62 of the cut out portion 42 of the bottom sleeve 20' to grasp one of the corresponding hooks 58 of the boot 32'.

To use the snow shield foot and leg insulator 10 the following 5 steps are taken:

1. The inner cloth tube 14 is sliped over the foot 22 and leg 24.
2. The lace 36 is tied in the top sleeve 18.
3. A pair of pants (not shown) is put on.
4. The boot 32 is put on the foot 22.
5. The lace 40 in the bottom sleeve 20 is tied within the eyelets 44 of the top portion 30 of the boot 32.

To use the snow shield foot and leg insulator 10A the following 6 steps are taken.

1. The inner cloth tube 14 is sliped over the foot 22 and leg 24.
2. The lace 36 is tied in the top sleeve 18.
3. A pair of pants (not shown) is put on.
4. The boot 32 is put on the foot 22.
5. The pull taps 48 are pulled until the inner mid seal engages the top edge 52 of the boot 32.

6. The lace 40 in the bottom sleeve 20 is tied within the eyelets 44 of the top portion 30 of the boot 32.

To use the snow shield foot and leg insulator 10B the following 5 steps are taken:

1. The inner cloth tube 14 is sliped over the foot 22 and leg 24.
2. The lace 36 is tied in the top sleeve 18.
3. A pair of pants (not shown) is put on.
4. The boot 32' is put on the foot 22.
5. The elastic loops 56 are placed around the corresponding hooks 58 of the boot 32'.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A snow shield foot and leg insulator which comprises:

(a) an inner cloth tube for engagement with a foot and leg;

(b) an outer cloth tube having its top edge attached to top edge of said inner cloth tube forming a seam;

(c) a top sleeve attached to the seam for securing the seam to the leg; and (d) a bottom sleeve attached to a bottom edge of said outer cloth tube for securing the bottom edge around a top portion of a boot placed onto the foot to prevent snow from seeping into the top portion of the boot wherein said top sleeve comprises:

(a) at least one elastic band attached thereto; and (b) at least one lace integrated within said top sleeve wherein said bottom sleeve comprises:

(a) at least one elastic band attached thereto and (b) at least one lace integrated within said bottom sleeve, said bottom sleeve having a front cut out portion exposing eyelets in the top portion of the boot so that said lace can engage the eyelets.

2. As now shield foot and leg insulator as recited in claim 1, wherein said inner cloth tube is made of a 100% nylon shell having a core of 100% polyester filler.

3. A snow shield foot and leg insulator as recited in claim 2, wherein said outer cloth tube is made of 100% nylon.

4. A snow shield foot and leg insulator as recited in claim 2, wherein said outer cloth tube further comprises:

(a) an inner mid seal attached along inner circumference of said outer cloth tube to engage top edge of the boot; and (b) a plurality of pull tabs attached along outer circumference of said outer cloth tube in the vicinity of said inner mid seal to the top edge of the boot.

5. A snow shield foot and leg insulator as recited in claim 1, wherein said bottom sleeve comprises:

(a) a pair of loops, said bottom sleeve having a front cut out portion exposing hooks in the top portion of the boot, each said loop attached to a side of the cut out portion of said bottom sleeve to grasp one of the corresponding hooks of the boot.

* * * * *